US009095762B2

(12) United States Patent
Buresta

(10) Patent No.: US 9,095,762 B2
(45) Date of Patent: Aug. 4, 2015

(54) SYSTEM FOR LIGHT SIGNALLING TO SUPPLY A MOVING LIGHT REFERENCE TO AN ATHLETE

(75) Inventor: Alessandro Buresta, Turin (IT)

(73) Assignee: Alessandro Buresta, Turin (IT)

( * ) Notice: Subject to any disclaimer, the term of this patent is extended or adjusted under 35 U.S.C. 154(b) by 869 days.

(21) Appl. No.: 13/265,369

(22) PCT Filed: Apr. 19, 2010

(86) PCT No.: PCT/IB2010/051701

§ 371 (c)(1),
(2), (4) Date: Dec. 29, 2011

(87) PCT Pub. No.: WO2010/122480

PCT Pub. Date: Oct. 28, 2010

(65) Prior Publication Data

US 2012/0091921 A1 Apr. 19, 2012

(30) Foreign Application Priority Data

Apr. 20, 2009 (IT) ..... TO2009A000305

(51) Int. Cl.

| | |
|---|---|
| ***F21S 10/02*** | (2006.01) |
| ***A63B 71/06*** | (2006.01) |
| ***A63B 69/12*** | (2006.01) |

(52) U.S. Cl.

CPC ..... *A63B 71/0686* (2013.01); *A63B 69/12* (2013.01); *A63B 2207/02* (2013.01); *A63B 2225/15* (2013.01); *A63B 2225/50* (2013.01); *A63B 2225/54* (2013.01)

(58) Field of Classification Search

USPC ..... 362/559, 555, 551, 362, 217, 227, 232, 362/233

See application file for complete search history.

(56) References Cited

U.S. PATENT DOCUMENTS

| | | | | |
|---|---|---|---|---|
| 6,086,379 | A | 7/2000 | Pendergast | |
| 6,882,117 | B1 * | 4/2005 | Hughes et al. | 315/291 |

(Continued)

FOREIGN PATENT DOCUMENTS

| | | |
|---|---|---|
| GB | 2 175 508 | 12/1986 |
| GB | 2 293 677 | 4/1996 |

(Continued)

OTHER PUBLICATIONS

International Search Report for PCT/IB2010/051701, mailed Oct. 1, 2010.

(Continued)

*Primary Examiner* — Tuyet Vo
(74) *Attorney, Agent, or Firm* — Nixon & Vanderhye, PC

(57) ABSTRACT

System for light signalling to supply a moving light reference (60) to an athlete, said system (10) including a plurality of lighting elements (20), in particular light emitting diodes, arranged along an athlete path, controlling means (11, 19) adapted to control said plurality of lighting elements (20) according to a lighting sequence adapted to generate said moving light reference (60) and to impart to said moving light reference (60) a displacement speed along said plurality of lighting elements (20) which is settable through said controlling means (11, 19). According to the invention, said system (10) further comprises a plurality of microcontrollers (23) arranged in a cascaded connection with respect to command signals (42) pertaining lighting parameters sent by said controlling means (11, 19) and arranged along said athlete path, said microcontrollers (23) being connected to respective sets of lighting elements in said plurality of lighting elements (20) to command their lighting state on the basis of said command signals (42).

21 Claims, 4 Drawing Sheets

(56) References Cited

U.S. PATENT DOCUMENTS

| | | | | |
|---|---|---|---|---|
| 2007/0182567 | A1 | 8/2007 | Stewart | |
| 2012/0002406 | A1 * | 1/2012 | Leadford et al. | 362/217.14 |

FOREIGN PATENT DOCUMENTS

| | | |
|---|---|---|
| WO | WO 85/03881 | 9/1985 |
| WO | WO 89/08477 | 9/1989 |
| WO | WO 2008/022356 | 2/2008 |

OTHER PUBLICATIONS

Written Opinion of the International Searching Authority for PCT/IB2010/051701, mailed Oct. 1, 2010.

Termin et al., Pace Lights and Swim Performance, pp. 18-20, Oct.-Dec. 1999, Sports Publications International, Swimming Technique, v. 36, No. 3.†

* cited by examiner
† cited by third party

SYSTEM FOR LIGHT SIGNALLING TO SUPPLY A MOVING LIGHT REFERENCE TO AN ATHLETE

This application is the U.S. national phase of International Application No. PCT/IB2010/051701, filed 19 Apr. 2010, which designated the U.S. and claims priority to Italy Application No. TO2009A000305, filed 20 Apr. 2009, the entire contents of each of which are hereby incorporated by reference.

The present invention refers to a system for light signalling to supply a moving light reference to an athlete, said system including a plurality of lighting elements, in particular light emitting diodes, arranged along an athlete path, controlling means adapted to control said plurality of lighting elements according to a lighting sequence adapted to generate said moving light reference and to impart to said moving light reference a displacement speed along said plurality of lighting elements which is settable through said controlling means.

In many sport disciplines, particularly in disciplines such as swimming, skating or running, following and maintaining specific paces is required during training. With reference, for example, to swimming, usually a trainer at poolside signals time references, which he detects with a timer, to the athlete, together with other instructions relative to the pace to be kept and the lap times to be respected. However, such method has some inconveniences, since the athlete receives times and instructions only when passing by the trainer (for example, in the turns). Furthermore, training is often performed in a limited number of lanes in the pool, the other lanes being dedicated either to free swimming or swimming lessons, so that it may be difficult to hear the instructions due to noise originating from other lanes.

Patent application PCT WO85/03881 describes a system for light signalling as indicated in the preamble to claim 1. Such system envisions the arrangement of a plurality of lamps in an elongated fixture that are lighted in sequence from one end of the swimming pool to the other, so that a swimmer can see the lamps and maintain a desired swimming pace following the pace of the lighting of the lamps.

Such a system also has some inconveniences, since it envisions providing a light reference reproducing a constant pace, but is not suitable for different types of training. Furthermore, the structure of the system envisions complicated cabling, which makes it difficult to fit to different sports structures and different types of training other than those performed at a constant pace.

The present invention has the object of realising a system for light signalling that solves the inconveniences of the known art.

According to the present invention, such object is achieved by means of a system for light signalling having the features specifically recalled in the claims that follow. The invention also relates to a corresponding signalling method.

The system for light signalling according to the invention includes, in particular, a plurality of microprocessors arranged cascade connected along the athlete path and commanded by said controlling means, each microprocessor in said plurality of microprocessors being connected so to command the switching on of one or more lighting elements.

By means of the above-indicated features, the proposed system for light signalling substantially allows generation of a light reference to simulate the performance of a ghost athlete who moves at a programmable speed, variable even instant by instant, according to any preset profile.

Further features and advantages of the invention will be obvious from the description that follows, with reference to the annexed drawings, provided by way of non-limiting example only, wherein.

In brief, the proposed system for light signalling is based on the observation that more often it can be useful for an athlete to compete with a ghost adversary, that is, with a reference that is not moving at a constant pace, but with an truly variable speed profile, which for example, replicates the real performance of an adversary recorded at a previous time.

To simulate the effect of continuous and fluid movement of the light cursor with the light signalling system, so to simulate a ghost athlete who moves at a variable speed, representing also accelerations and decelerations, according to the invention, the use is envisioned of an elevated number of light signalling elements spaced at a distance such that the eye of the athlete perceives a fluid, rather than discontinuous motion, with the purpose of providing not only the pace, but a comparison of the travelling speed and relative variations, as if really competing against a rival.

Such evaluation preferably occurs on the basis of a typical velocity attributed to an athlete in a certain sport, for example, using the average travel velocity of a swimmer as the typical velocity (eg. 2-3 m/s), it appears to be necessary for this purpose to arrange the elements at a reciprocal distance apart of approximately 33 mm. For example, to guarantee the effect of fluidity, 150 LEDs every 5 m of length may be installed. The use of LEDs of different brightness may influence such distance.

The system for light signalling according to the invention envisions controlling the switching on and switching off of each element individually in such a high number of light signalling elements. For this purpose, the system implements a signalling protocol based on the use of signalling lines, in particular, two signalling cables, and supply lines, in particular two supply cables, controlling a plurality of microcontrollers, themselves controlling one or more LEDs, cascade connected, so to use a limited number of connections, in particular four, for the entire length of the lighted lane.

In order to optimise construction and possible maintenance it was established that preferably a system be constructed that could be sectioned every 10 cm. In practice, each 10 cm module can be replaced with another equivalent module and easily integrated into the lighted lane.

A local control module is envisioned including a module for controlling the diodes and a supply module, the control module being configured to be connectable in a relationship of sending or exchanging signals with said plurality of light elements. The system for light signalling further includes a remotely arranged control module preferably in wireless communication with such local control module.

Figure 1:
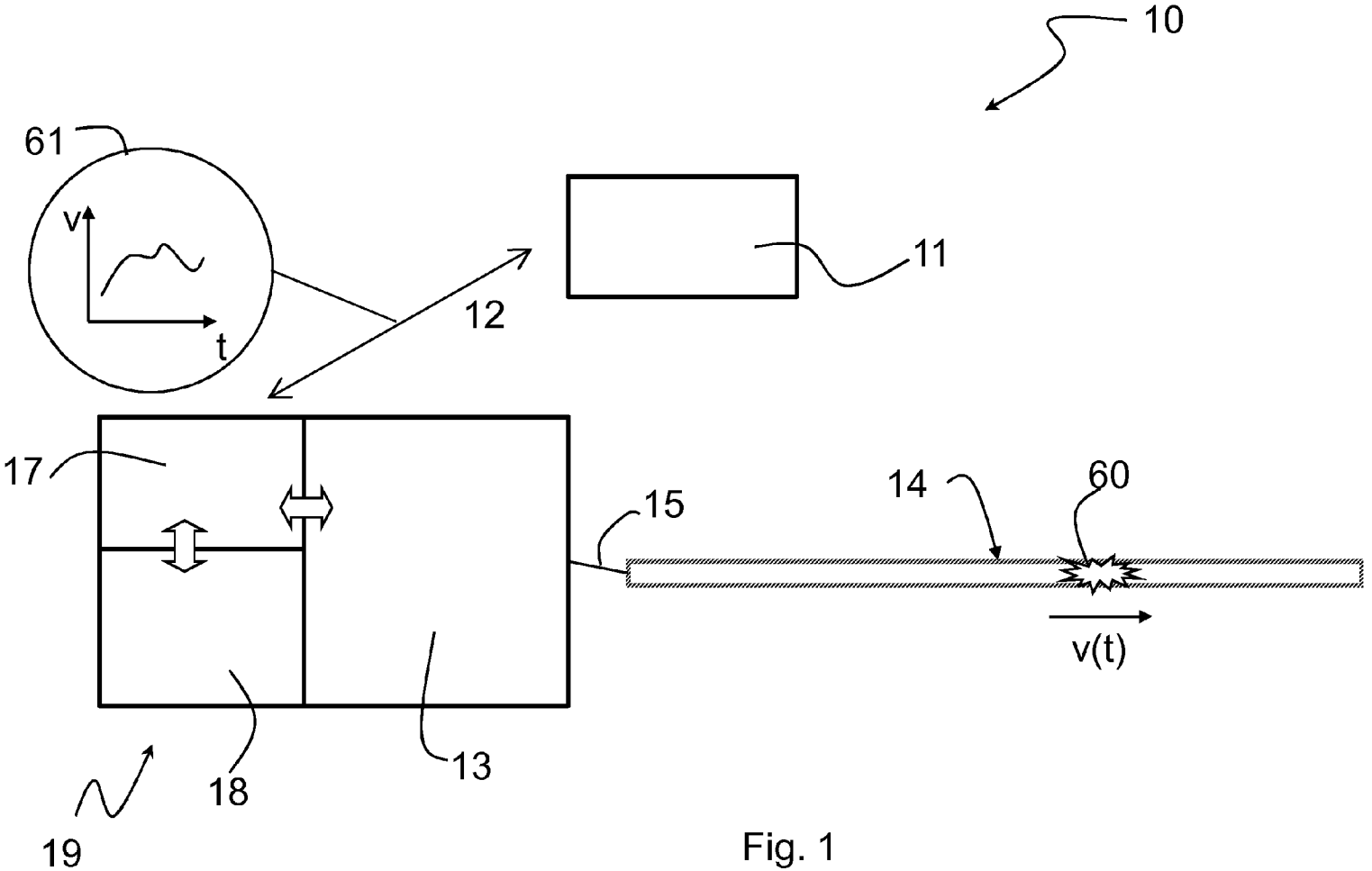
FIG. 1 represents a schematic diagram of a system for light signalling according to the invention.

FIG. 1 shows a schematic diagram of a system for light signalling according to the invention, indicated as a whole with the reference 10.

Such system for light signalling 10 includes a remotely located control module 11 in wireless communication with a local control module 19 to control a light strip 14 connected to it. For example the remote control module 11 can be located in an office or locker room or on the stands, while the local control module 19 is located, in the case of a swimming pool, at poolside. Such local control module 19 includes a wireless transceiver 17, apt to allowing the exchange of signals on the wireless channel 12. In this way, it is possible in particular to establish a signal exchange between the remote control module 11 and a light strip driving module 13, itself included in the local control module 19. Such light strip driving module 13 is connected through a cabled connection 15 to the light strip 14 located preferably along the floating lane divider in the example herein of a swimming pool. The local control module 19 also includes an RFID (Radio Frequency Identification) reader 18, to detect signals coming from RFID tags associated with the athletes, for example, located in their swimming caps, to permit the identification of the athlete. The RFID reader 18 can then communicate the data read through the wireless channel 12 to the remote control module 11.

The remote control module 11 is realised preferably as a computer such as a personal computer, on which managing software is installed. Alternatively, the personal computer can be also a palm computer, a smart phone or equivalent device.

The light strip driving module 13 drives the switching on of the light elements of the light strip 14, so to simulate the displacement of a light cursor travelling according to speed profiles established with the software installed on the remote control module 11.

FIG. 1 shows only one light strip 14 but preferably the light strip driving module 13 is configured to drive several light strips 14 in parallel, that is, several lanes.

Figure 2:
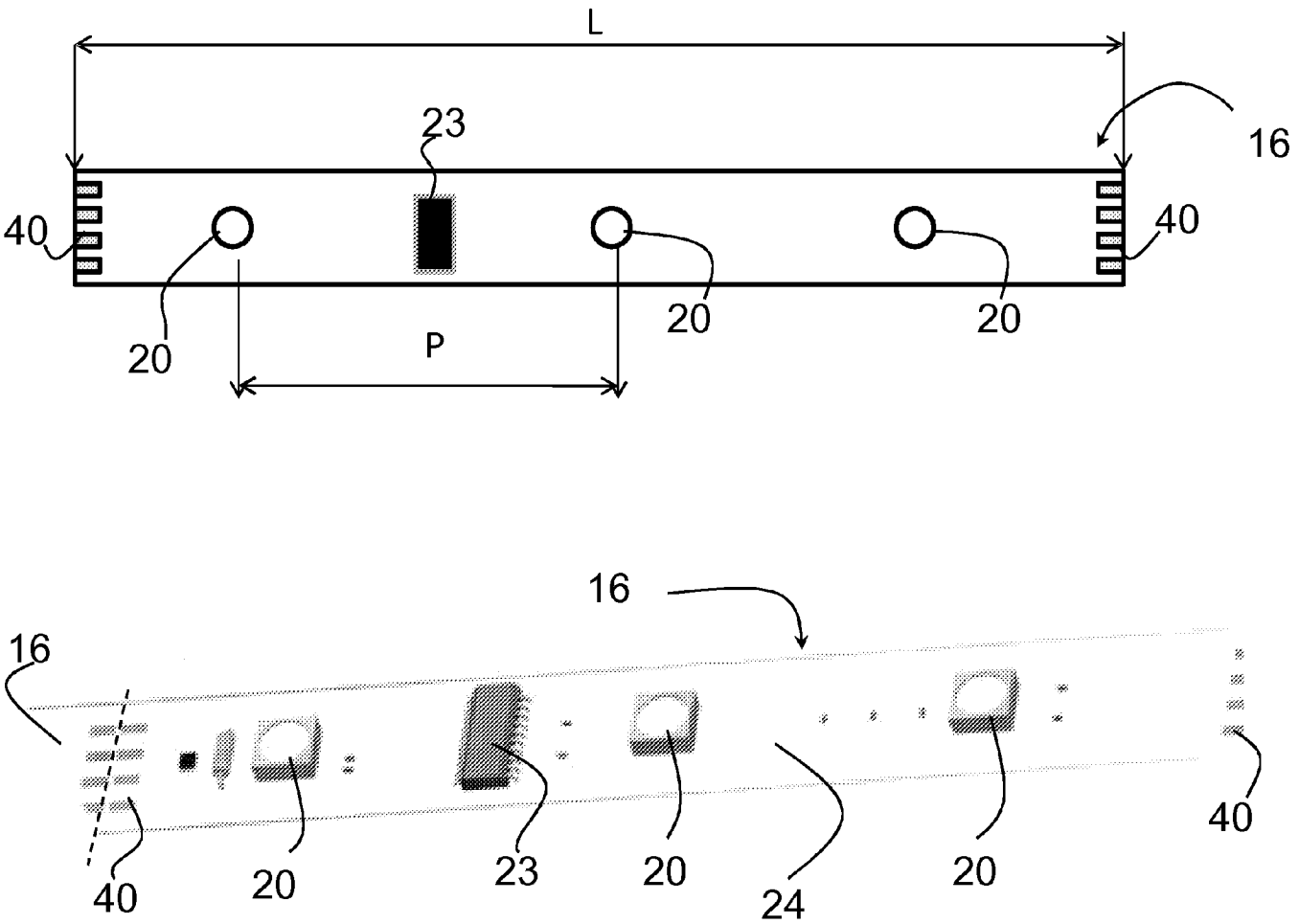
FIG. 2 represents a lighting module of the system according to the invention in plan and in prospective views.

The light strip 14 is preferably made up of lighting segments 16, as shown in FIG. 2, where a lighting segment 16 is shown in plan and prospective views. The light segments 16 are electrically and mechanically connected together to form the light strip 14. Such lighting segment 16 includes, an elongated flexible support structure 24, which has contacts 40 at its two extremities to allow the interconnection of other light segments 16. The contacts 40 are copper traces, preferably realised continuous in the production phase and then sectioned, making for example support structures 5 meters long that can be sectioned every 10 cm. Since the junctions between the contacts are made of copper traces, they are preferably connected by soldering and with the use of flexible mini flat packages to avoid stiffening the structure.

The lighting segment 16 has, for example, a length L of 100 mm and includes LEDs 20, arranged at a periodic step P, for example of 16.54 mm, in particular RGB LEDs. The lighting segment 16 in FIG. 2 includes, in particular, three LEDs 20 arranged with step P on the support structure 24, as indicated, for example, at 33 mm, as well as a microcontroller 23 which, as will be shown with reference to FIG. 4, commands the switch on of such LEDs 20. In the example described, the support structure 24 has a thickness of 0.3 mm, while the LEDs 20 have an overall height of 2.4 mm including the thickness of the support structure. The width of the support structure 24 is 8 mm.

Figure 3:
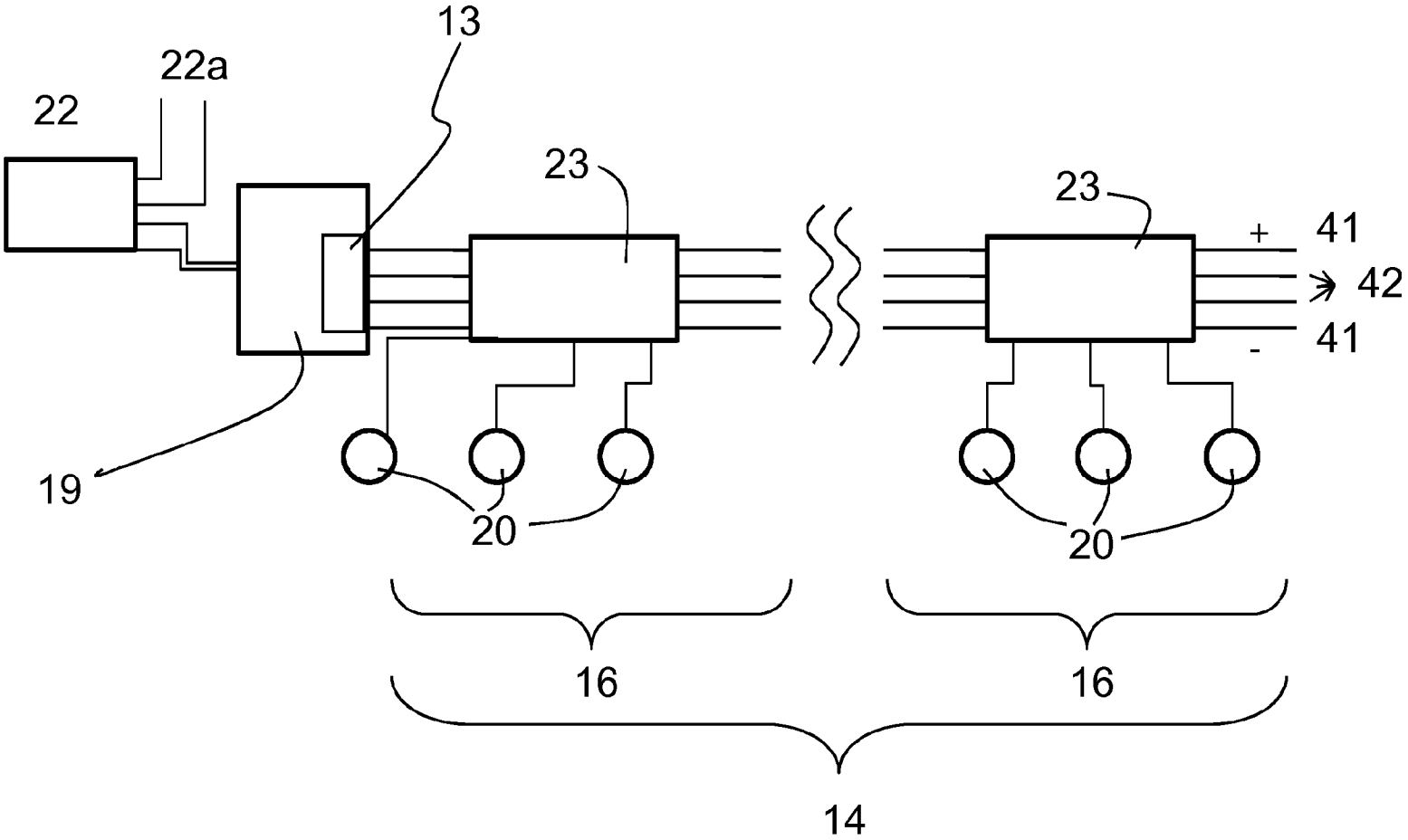
FIG. 3 represents a circuit diagram of said lighting module of the system according to the invention.

FIG. 3 shows a circuit diagram of the segment 16 together with part of the local control module 19. In particular, the driving module 13 which is associated with a supply module 22, that is, a supply receiving the line voltage through a supply line 22*a* is represented. Such supply module 22 provides continuous voltage at 12V to the driving module of the light strip 13, controlling the signals sent to the LEDs 20. Four wires originate from the light strip driving module 13 going towards the first segment 16, two supply wires 41 and two signal wires 42, respectively. The supply wires 41 carry the voltage at 12V to the input of the first microcontroller 23 of the first segment 16, while the signal wires 42 enter the respective signalling inputs. Thus the microcontroller 23 includes a plurality of output pins or clamps to drive LEDs 20 connected thereto, according to the commands received over the signal lines 42. The microcontroller 23 also envisions four output pins to re-send the supply voltage and the signals in cascade to the next microcontroller 23, that is, for example, the preceding signal output 42 of the microcontroller 23 coincides with the signal input 42 of the microcontroller 23 that follows. It is optionally envisioned to insert into one or more of the segments 16 that make up the lighting strip 16 a continuous amplifier receiving the supply voltage at 12V through dedicated cabling directly from the supply module 22 to re-establish the supply voltage.

Figure 4:
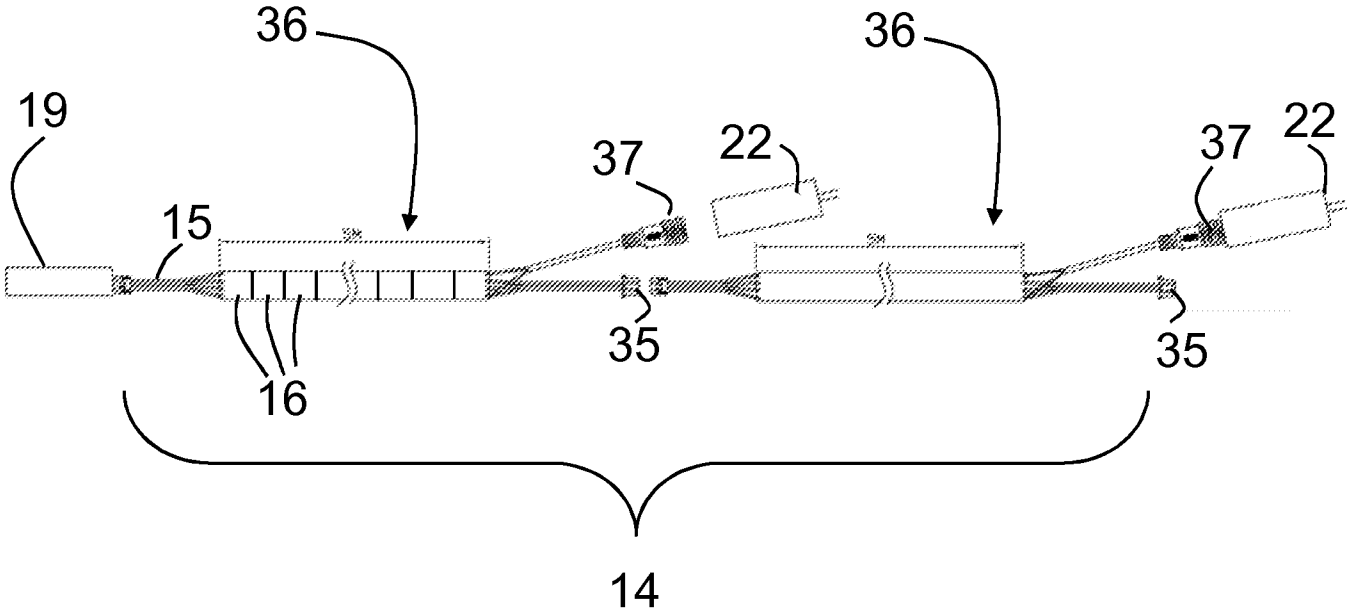
FIG. 4 represents an assembly diagram of the system according to the invention.

According to a variant, shown schematically in FIG. 4, it is envisioned to group the segments 14 interconnected by way of the contacts 40 into macro segments 36, for example, 5 meters long, themselves connected together through cabling 35 and having a supply connector 37 to supply said amplifier. FIG. 4 shows an example of a lighting strip 16 made of macro segments.

Thus, the proposed system of light signalling envisions that, in the remote control module 11 it is possible, for example through a dedicated graphic interface of the managing software, to allow the user to input the various control training parameters, in particular, a specific speed profile 61, for example one of speed as a function of time (Vt), of a light reference 60 to which some light parameters of the LEDs 20 correspond. The speed profile 61 includes, for example, portions which are representative of speed variations such as accelerations and decelerations to which corresponds, in terms of lighting parameters, a specific pacing of the switch on times of the LEDs 20 along the light strip 16. In this way, the light reference 60 moves at a variable speed along the light strip 14 and reproduces instant by instant the trend of the performance of a comparison athlete, that is, a so-called ghost competitor.

Through the wireless communication channel 12, Bluetooth, Wi-Fi, Zig-Bee or another type of wireless technology compatible with such application, or alternatively, via USB or RS232 interface in the case in which the communication channel 12 operates by a wire, such parameters are transferred from the control computer of the module 11 to the driving module 13 in the local control module 19. Upon receiving the lighting parameters by wire or wireless, such driving module 13 transmits them on the signal wires 42 according to a proprietary protocol on the light strip 14 to the first microcontroller 23. Each controller 23 decodes the commands addressed to it relative to the lighting parameters, controlling the lighting, or switching on, of the LEDs 20 connected to the its own driving outputs according to the timing specified in such commands, and re-transmits the command package to the next microcontroller.

More in particular, the protocol of communication with the microprocessors 23 may envision that the control module, local or remote, is configured, in particular in the installation phase, for verifying the length of the light strip 14 to which is it connected, to count the microcontrollers 23 present on the light strip 14, to verify whether all of the microcontrollers respond with an ack (acknowledge) answering signal. Next, it is envisioned that the control module 11 or 19 sends an information package to the first microcontroller 23 with the lighting parameters including the timing information for the lighting of the LEDs 20. Once the step of lighting the LEDs 20 associated with it is executed in accordance with the respective lighting parameters, each microcontroller 23 sends the information to the next controller until the end of the light strip 16 is reached. The input to the next microcontroller 23 is preferably conditional on the reception of timing information that it receives from the preceding microprocessor 23.

In addition to the timing information, the total number of microcontrollers 23 present in the light strip 14 (in the case in example there is one every 10 cm, thus 250 or 500, depending on whether it is a 25 m or 50 m swimming pool) is also sent to the microcontrollers 23 and when that number is reached, the light reference 60 must follow the reverse course. Preferably, the microcontrollers 23 also include a serial connection to the signal lines 42 in addition to the connection in cascade, and the protocol managing them is configured to allow sending information to each individual address assigned to the various microcontrollers. Such serial connection preferably serves functions such as counting the controllers present and functioning, for example, in an initial control phase, so to avoid that the use of only the cascade connection could possibly block operations due to a damaged microcontroller.

In order to follow the athlete path, the light strip 14 is preferably inserted inside a transparent plastic tube, preferably a watertight flexible sheath having a rectangular section, for application in swimming pools. The light strip 14 inserted into the transparent plastic tube may be connected to existing wave-breaking lane dividers with dedicated hooks or it may be inserted in the divider already in its production phase.

In the case of applications in tracks such as track and field athletics, the light strip 14 may instead be imbedded into the tartan resin. In another variant for application on ice tracks, the light strip 14 may be inserted beneath the ice layer itself, preferably selecting watertight components resistance down to temperatures of −40° C.

The light strip 14, as can be deduced from its dimensions previously mentioned by way of example, may be disassembled and rolled with a minimum radius of 10 centimeters. Such minimum rolling radius of 10 cm refers to the radius of the first circle constituting the rolled light strip 14 and it represents a preferred dimension to avoid the onset of excessive mechanical stresses due to rolling of the support structure 24. The size of the components also allows radii down to at least 3 cm and it is obvious that shorter radii are possible using components with smaller dimensions and supports with different mechanical properties.

As previously mentioned, according to a further aspect of the invention, it is envisioned that the local control module 19 be equipped with an RFID reader 18 and to correspondingly supply the athletes with a transponder, or RFID tag, located, for example, in their swimming caps, to signal his identity to the remote control module 11. Based on the identity signalled by the RFID reader 18 through the channel 12, such remote control module 11 can select and command the training profile corresponding to the athlete automatically, or under the control of an operator. Furthermore, it is also envisioned that the multicolour emission capacity of the RGB LEDs 20 be exploited to associate light cursors of different colours to different athletes. In this way, it is possible to have several athletes training in the same lane following personalised cursors. In general, the adoption of a multiplicity of microprocessors receiving specific commands for a group or set of LEDs allows independent adjustment of a large number of lighting parameters of such LEDs, from the simple on/off states, to colours, light intensity, to timing. Note that, even if in FIG. 2 each microprocessor 23 is connected to sets of three LEDs 20, each LED can be commanded independently by means of an output of the microprocessor 23, as it is also possible to envision associating a microprocessor 23 with a set containing only one LED.

Thus, from the above description, the advantages of the invention are clear.

By adopting light strips with a large number of LEDs that allow for a plurality of lighting elements arranged along the athlete path, the system for light signalling of the invention advantageously displays a light reference that is able to vary its displacement speed with continuity, allowing also simulation of accelerations and decelerations, that is, simulating the presence of a reference athlete, or ghost athlete.

Advantageously, the cascade arrangement of microcontrollers and light elements is suitable for use with other light element control standards, for example, the DMX standard.

Driving of the large number of lighting elements, arranged along the track with a step correlated to the average travel velocity of the athlete, is advantageously obtained with the insertion of microcontrollers apt to drive sets of LEDs, in particular according to a protocol and a cascade connection, thus minimising the number of cables required and also allowing more complex light signals to be obtained with respect to a simple pace given by a lighting sequence. The reduced cabling is also particularly advantageous for embodiments such as those in environments where water-tightness is required, such as swimming pools.

The system according to the invention also advantageously provides for location of part of the system control remotely and part of the control locally, in proximity of the pool or track, so to be able to easily employ a computer with corresponding calculating power and ease of use, to set the speed and acceleration profiles to then be translated into the corresponding lighting parameters commanding the light strip associated to the lane.

Naturally, keeping the principle of the invention constant, the details of construction and the embodiments may vary widely with respect to what is described and illustrated by way of example only, without departing from the scope of the present invention.

The control means, remote and/or local, are configured to set the displacement speed according to a variable speed profile, such profile being able to contain accelerations and/or decelerations, not only in the form of an almost instantaneous passage from one pace to another, but also of an actual accelerated or decelerated motion, according to any kinematic parameter curve.

Although in the examples described a light strip has been mentioned, any support suitable for realising a sequential arrangement of lighting elements along the athlete path may be used, in particular, not necessarily a support in the form of a flattened strip.

The lighting elements are preferably light emitting diodes (LEDs), but it is clear that it is possible to select other devices apt to emit light under the control of the processor, such as incandescent devices or optical fibre systems. It is also possible to substitute the LEDs with flat OLED (organic light emitting diode) devices.

The arrangement of the local control module provided with the RFID reader and transceiver module at poolside or trackside may be employed not only for the setting of the training programs with in-lane athlete recognition but also for other functions more generally related to the management of information on the thusly identified athlete, for example, on-screen visualisation of athlete data, possibly visible also to the public, or also for registration purposes and possibly for invoicing, when use of the sports facility is rented.

It is clear that, in a very simplified version of the system of the invention, the control means of the light strip might have a local and remote module concentrated in the same module, located at poolside or remote located and connected to the strip, for example, by cable.

Possible fields of application of the proposed system include swimming lanes, running tracks, ice skating tracks, indoor cycling tracks.

It is clear that by athlete, in the context of the present description, is intended a person dedicated to practicing a sport, even in an amateur context, as a hobby or for medical reasons.

The invention claimed is:

1. System for light signalling to supply a moving light reference to an athlete, said system including a plurality of lighting elements, in particular light emitting diodes, arranged along an athlete path, controlling means adapted to control said plurality of lighting elements according to a lighting sequence adapted to generate said moving light reference and to impart to said moving light reference a displacement speed along said plurality of lighting elements which is settable through said controlling means, wherein said system further comprises a plurality of microcontrollers arranged in a cascaded connection with respect to command signals pertaining to lighting parameters sent by said controlling means and arranged along said athlete path, said microcontrollers being connected to respective sets of lighting elements in said plurality of lighting elements to command their lighting state on the basis of said command signals, and wherein said controlling means include a control module arranged remote and a local control module arranged near the athlete path.

2. The system of claim 1, wherein said controlling means are configured to set said displacement speed according to a variable speed profile, in particular according a profile including portions which are representative of accelerations and/or decelerations.

3. The system of claim 1, wherein said microcontroller are connected to a supply line, in particular cascade connected to said supply line.

4. The system of claim 1, wherein includes means for detecting RFID (Radio Frequency Identification) signals.

5. The system of claim 1, wherein at least part of said lighting elements is arranged periodically at a distance which is a function of a typical speed of the athlete.

6. The system of claim 1 wherein said supporting structure includes segments which can be assembled electrically and mechanically one to the other to follow said athlete path, each segment including at least a microcontroller and the lighting elements associated to said microcontroller.

7. The system of claim 1 wherein one or more of said segments includes supply amplification means.

8. The system of claim 1 wherein said control module arranged remote wirelessly communicates with said local control module to transmit commands.

9. The system of claim 1 wherein said athlete path is a floating lane divider of a swimming pool.

10. The system of claim 1 wherein the system includes an elongated supporting structure, in particular flexible, to support said microcontrollers and said lighting elements, in particular said supporting structure being inserted in a plastic transparent tube.

11. The system of claim 10 wherein the plastic transparent tube is a waterproof flexible sheath having a rectangular section.

12. A system for light signalling to supply a moving light reference to an athlete, said system including a plurality of lighting elements, in particular light emitting diodes, arranged along an athlete path, controlling means adapted to control said plurality of lighting elements according to a lighting sequence adapted to generate said moving light reference and to impart to said moving light reference a displacement speed along said plurality of lighting elements which is settable through said controlling means, wherein said system further comprises a plurality of microcontrollers arranged in a cascaded connection with respect to command signals pertaining to lighting parameters sent by said controlling means and arranged along said athlete path, said microcontrollers being connected to respective sets of lighting elements in said plurality of lighting elements to command their lighting state on the basis of said command signals, wherein said controlling means include a control module arranged remote and a local control module arranged near the athlete path, and wherein said control module arranged remote wirelessly communicates with said local control module to transmit commands.

13. The system of claim 12, wherein said controlling means are configured to set said displacement speed according to a variable speed profile, in particular according a profile including portions which are representative of accelerations and/or decelerations.

14. The system of claim 12, wherein said microcontrollers are connected to a supply line, in particular cascade connected to said supply line.

15. The system of claim 12, wherein includes means for detecting RFID (Radio Frequency Identification) signals.

16. The system of claim 12 wherein at least part of said lighting elements is arranged periodically at a distance which is a function of a typical speed of the athlete.

17. The system of claim 12 wherein said supporting structure includes segments which can be assembled electrically and mechanically one to the other to follow said athlete path, each segment including at least a microcontroller and the lighting elements associated to said microcontroller.

18. The system of claim 12 wherein one or more of said segments includes supply amplification means.

19. The system of claim 12 wherein said athlete path is a floating lane divider of a swimming pool.

20. The system of claim 12 wherein the system includes an elongated supporting structure, in particular flexible, to support said microcontrollers and said lighting elements, in particular said supporting structure being inserted in a plastic transparent tube.

21. The system of claim 20 wherein the plastic transparent tube is a waterproof flexible sheath having a rectangular section.

* * * * *